United States Patent [19]

Uhlig

[11] 4,088,239

[45] May 9, 1978

[54] PLASTIC DRUM AND METAL HANDLING RING

[75] Inventor: Albert R. Uhlig, Toledo, Ohio

[73] Assignee: Owens-Illinois, Inc., Toledo, Ohio

[21] Appl. No.: 799,866

[22] Filed: May 23, 1977

[51] Int. Cl.[2] ..... B65D 7/02; B65D 25/28; B65D 25/00

[52] U.S. Cl. ..... 220/5 R; 220/94 R; 220/85 K; 220/71

[58] Field of Search ..... 220/94 R, 71, 73, 85 R, 220/85 K, 5 R

[56] References Cited

U.S. PATENT DOCUMENTS

| | | | |
|---|---|---|---|
| 1,197,924 | 9/1916 | Ellinger | 220/320 |
| 3,955,705 | 5/1976 | Dubois et al. | 220/71 X |
| 4,022,345 | 5/1977 | Butz | 220/85 K X |
| 4,024,979 | 5/1977 | Craig et al. | 220/85 K X |

*Primary Examiner*—William Price
*Assistant Examiner*—Steven M. Pollard
*Attorney, Agent, or Firm*—Charles S. Lynch; E. J. Holler

[57] ABSTRACT

Disclosed is a plastic drum having a circumferential recess in the sidewall of the drum near its top, in the form of a frustum of a cone and adapted to receive a one-piece snap-on metal ring carrier structure of a disclosed design that allows handling of the drum with fork lifts, parrot beaks and similar chime engaging devices.

9 Claims, 8 Drawing Figures

PLASTIC DRUM AND METAL HANDLING RING

This invention relates to a unique plastic drum structure adapted to receive a snap-on metal ring carrier structure and to such a drum with such a ring carrier structure in place.

Because of the long time usage of steel drums for handling of materials in bulk, standard equipment has been developed to handle such drums by gripping the chime thereof in order that the drums may be transported and moved. That type of standard equipment is generally recognized, and referred to in the art, as steel drum chime-handling devices or, simply, chime-handling devices. One type of chime-handling device which has wide utility is referred to in the art as a parrot-beak device or, occasionally, as a cherry picker and one such device is sold by the Little Giant Company under the designation Grip-O-Matic. This type of device includes two opposed pivotal, or movable, jaws or beaks which, when brought into contact with a chime on a drum are adapted to open so as to allow them to be positioned with the chime between them and, upon lifting of the drum, the chime is lockingly gripped between the jaws or beaks, allowing for movement and transportation. Other chime-handling devices, such as those referred to as a chime-grabber, and hand truck, likewise include a beak, or jaws, or hooks, to exert a localized force on the chime which allows for the drum to be lifted and then appropriately moved. Also, a fork lift can be used to engage the chime for lifting of the drum.

More recently, plastic drums have been made available for much the same service as steel drums, but unfortunately these drums have not yet attained their full potential. It will be appreciated that such drums offer many highly desirable characteristics. Some of these desirable characteristics include, for example, low price, low shipping costs, a wide scope of product applications without the need for liners, ability to handle materials corrosive to metals, high resistance to the detrimental influence of weather, low unit weight, rust resistance, dent resistance, and in general they are highly aesthetically pleasing. A significant deterrent to the wider acceptance and usage of such plastic drums, such as one-piece, blow mold plastic drums, has been that conventional steel drum chime-handling devices cannot conveniently and interchangeably be employed with plastic drums and steel drums for movement and expeditious handling of both.

It is one object of the present invention to provide a plastic drum adapted for snap-on attachment of a metal ring carrier structure enabling the drum to be handled by metal drum chime-handling equipment.

it is a further object to provide such a plastic drum that can be handled by a hook and hoist lifting equipment when such metal carrier structure is in place.

Yet another object of the present invention is to provide such a drum-metal ring structure which is economical and easily assembled.

Other objects, features and aspects, as well as advantages, of the invention will become apparent from a study of the following description and drawings.

In one aspect of the invention, there is provided a plastic drum adapted to receive a snap-on metal ring carrier structure, said drum having a top end, a bottom end, a circumferential side-wall joining said top and bottom ends, and near said top end a circumferential recess in said sidewall in the form of a frustum of a cone, said recess defining a first circumferential upwardly facing ledge at its bottom and a second circumferential downwardly and outwardly facing ledge at its top, the outer diameter of said second ledge being less thn the outer diameter of said first ledge.

In accordance with another aspect of the invention there is provided a plastic drum of the foregoing description which also has two or more circumferentially spaced, vertical recesses, each of which extends from below said circumferential recess to above said circumferential recess, and is deeper than said circumferential recess.

In yet another aspect of the invention there is provided in combination, a drum having the foregoing features and a one-piece circumferential ring carrier structure made of flexible and resilient metal and having an inner frusto-conical skirt portion fitting tightly in said circumferential recess of said drum and curving at its bottom downwardly and outwardly, and then upwardly into a vertical essentially cylyndrical outer skirt portion, then inwardly in an essentially frusto-conical portion extending into a circumferential portion fitting snugly against the drum sidewall above said second circumferential ledge of said drum, and finally extending upwardly and terminating slightly above the top end of said drum, said ring having near its top a generally downwardly facing outer circumferential ledge adapted to be engaged by chime-handling equipment for lifting the drum, said inner skirt having at least one slot cut from its circumference, extending from the top of said inner skirt at least part way to the bottom of said inner skirt. In this aspect of the invention the ring structure in one embodiment fits snugly around the shoulder formed by the juncture of the top end and the sidewall of the drum.

An optional but advantageous feature of the described combination of plastic drum and metal ring structure is the provision of vertical recesses in the drum, as before mentioned, which when the ring structure is in place provides at each recess the necessary clearance, between the drum and the bottom of the metal ring carrier, to allow lifting the drum with hook and hoist by engagement of the metal ring with hooks at the bottom of the ring carrier structure.

Other features of the invention will be described in more detail in connection with a description of the drawings, including nesting of the drums with ring carriers attached and nesting of ring carriers for shipment by a snap-on action.

Figure 1:
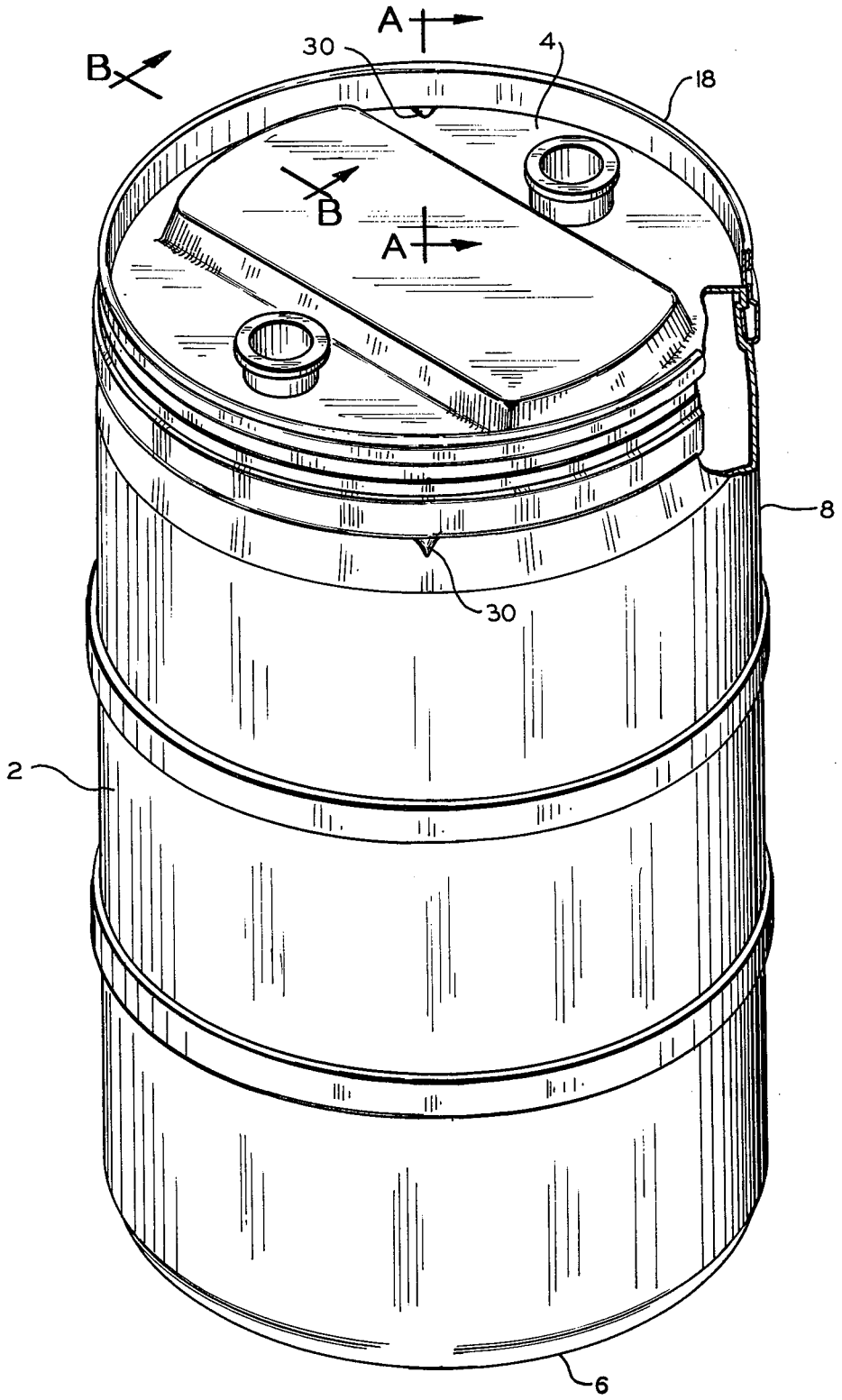
FIG. 1 is a perspective view of one embodiment of a plastic drum-ring carrier structure of the invention.
Figure 2:
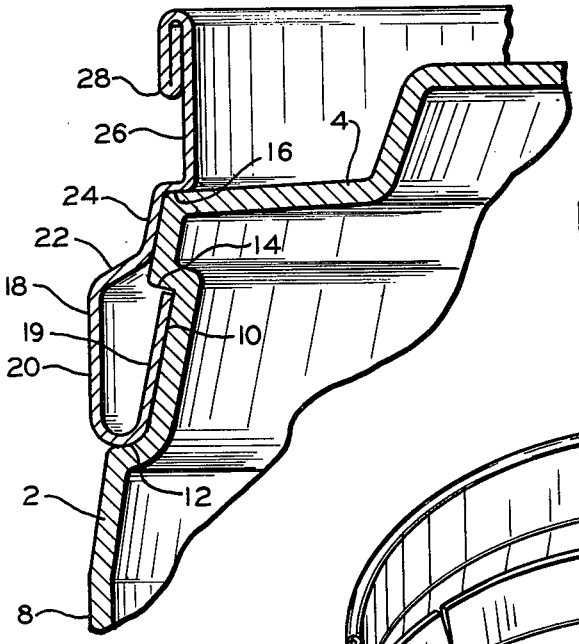
FIG. 2 is a partial cross-section along the plane B—B of FIG. 1 parallel to the axis of drum 2.

FIGS. 1–4 illustrate one now preferred embodiment of the invention. In FIG. 1 is shown a perspective view of one embodiment of a plastic drum-ring carrier structure of the invention. The profile of the top of drum 2 is shown in FIG. 2 as a partial cross-section along the plane B—B of FIG. 1 parallel to the axis of drum 2. Plastic drum 2 has top end 4 and a bottom end 6 (not shown) and a circumferential sidewall 8 joining the top and bottom ends. The portion shown in cut-away cross-section in FIG. 1 is like FIG. 2. Near the top end of drum 2, drum 2 has a circumferential recess 10 in sidewall 8 in the form of a frustum of a cone, defining upwardly facing circumferential ledge 12 and downwardly and outwardly facing circumferential ledge 14. Top shoulder 16 is formed by the juncture of top 14 and sidewall 2.

Figure 3:
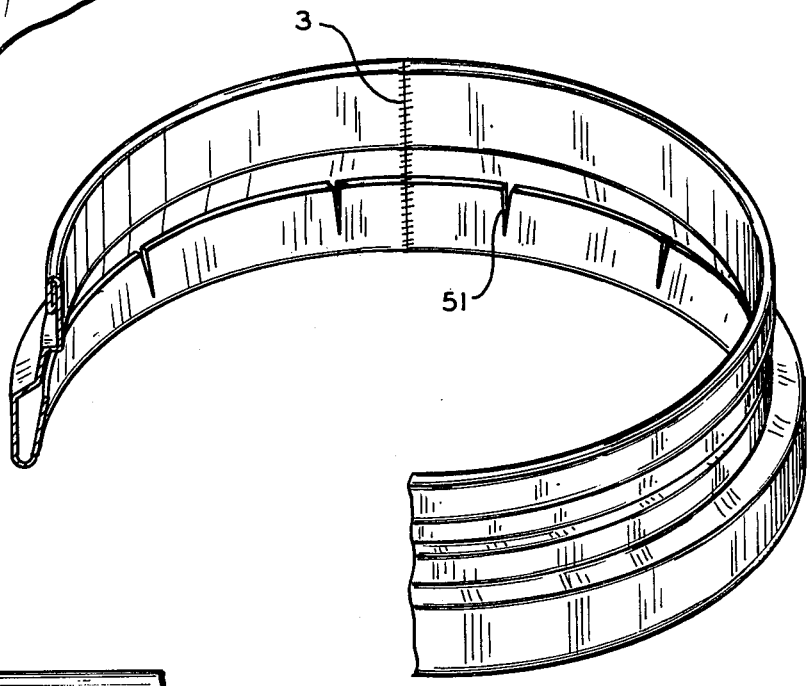
FIG. 3 is a partial perspective view of a ring of the invention, partially in cross-section.

Carrier ring 18 of FIGS. 1 and 2 is also shown in FIG. 3 before installation on a drum. One or more (usually at least 3 or 4) slots 51 which extend from the top of skirt 19 at least part way to the bottom of 19 allow flexing of skirt 19 so that ring 18 can be installed on drum 2 by pushing down a ring 18 past shoulder 16 and ledge 14 and snapped into place in recess 10. The flexible and resilient metal used is usually steel but can be an aluminum alloy or other suitable metal. The ends of the ring are joined at 3 by welding or any other suitable means. In FIGS. 1 and 2 ring 18 is firmly in place on the drum; frustoconical inner skirt portion 19 fits tightly in recess 10 and curves downwardly and outwardly and then upwardly into a vertical, essentially cylindrical outer skirt or sidewall portion 20, then inwardly in the form of an essentially frusto-conical portion 22 which joins circumferential portion 24 fitting snugly against the drum sidewall 8 above said circumferential ledge 14 of drum 2. The metal ring carrier extends upwardly, finally, in the form of a circumferential portion 26 that extends slightly above the top 4 of the drum. Optionally but desirably the lower part of 26 fits snugly around shoulder 16, as in FIGS. 1 and 2, but this is not necessary and such feature can be omitted as in the embodiment illustrated in FIG. 7. The top of 26 is rolled or otherwise formed into an outer peripheral generally downwardly facing ledge 28, enabling engagement by chime-handling devices and by a fork lift.

Figure 4:
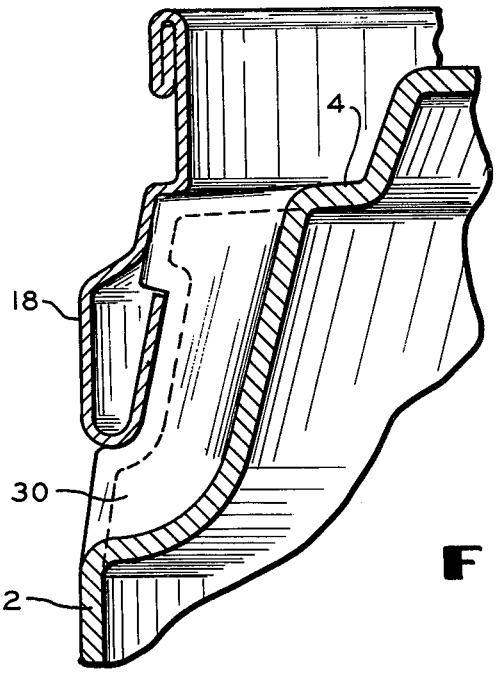
FIG. 4 is a partial cross-section taken at line A—A of FIG. 1.

In FIG. 1 openings or vertical recesses 30 are an optional, but a desirable feature which allows ring 18 to be engaged not only by chime-handling devices but also by hooks, enabling lifting by a hoist or the like. Optional vertical recesses 30 of FIG. 1 are also shown in FIG. 4, which is a partial section A—A of FIG. 1.

Figure 5:
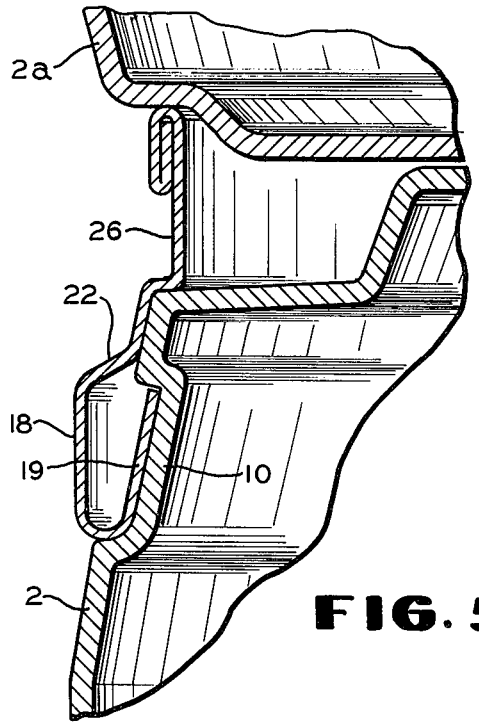
FIG. 5 is identical to FIG. 2 except that the bottom of another drum is shown in partial cross-section nested on top of the ring.

Another optional but important feature of this embodiment of the present invention is shown in FIG. 5 which is identical to FIG. 2 except that the bottom of another drum 2*a* is shown in partial cross-section nested on top of ring 18. Drum 2*a* is a modification of drum 2 wherein a peripheral, downwardly facing ledge is molded in bottom end 6 of the drum and is of a diameter to receive the top of ring 18. The relative dimensions are such that there is a clearance between the top of drum 2 and the bottom of drum 2*a*, at least when drum 2*a* is substantially empty, so that the ring actually supports the drum.

Figure 6:
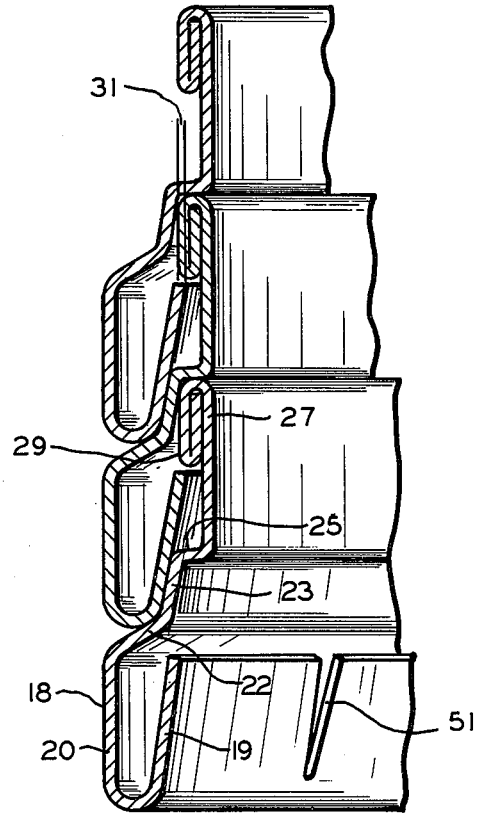
FIG. 6 shows in partial cross-section several identical rings of FIGS. 1–4 nested together.

An especially advantageous structure of circumferential ring 18 is described in connection with FIG. 6, which shows several identical rings 18 nested together. Each ring has frustoconical inner skirt portion 19 which has at least one slot 51 extending from its top at least part way to its base and which at its base curves downwardly and outwardly and then upwardly into a vertical skirt or sidewall portion 20, which from its top extends inwardly in the form of frustum of a cone 22 having a smaller angle with the horizontal than said inner frustum 19, which frustum 22 extends into frusto-conical portion 23 which has (i) essentially the same angle with the horizontal as frustoconical portion 19 and (ii) essentially the same base outer diameter as the base inner diameter of frusto-conical portion 19, said frusto-conical portion 23 terminating at its top in inwardly radially extending essentially horizontal annular ring section 25 which terminates at its inner periphery in upwardly extending vertical cylinder 27 having at its top outwardly radially extending downwardly facing ledge 29 whose outer diameter is just slightly greater than the inner peripheral diameter of frustoconical portion 19 so that each identical ring when nested over the other (i) snap fits past the ledge 29 of the next lower ring and is held in place by virtue of interference overlap shown at 31 and (ii) fits against and rests on frustum 23 of the next lower ring.

The ability to stack rings 18 one on the other in a stable and lightly locked condition has several practical advantages. First is the fact that shipment, storage, and handling are obviously simplified. Second, the ring stack can be pressed down over a drum and then the remainder of the stack forcibly but easily pulled off the lower ring locked into the recess 10 of a drum 2 by grasping the next higher ring and lifting the stack upwardly with a force sufficient to overcome the interference lock.

Figure 7:
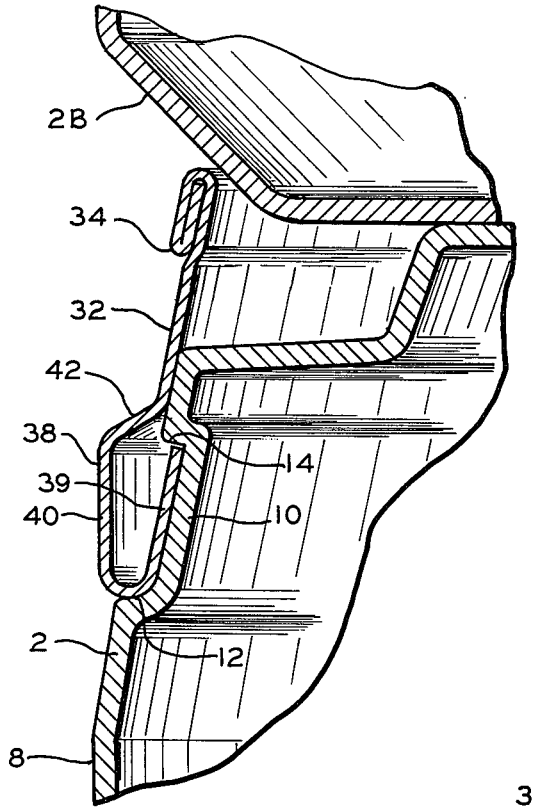
FIG. 7 illustrates another embodiment of the carrier ring-drum structure of the invention in partial cross-section.

Another embodiment of the carrier ring-drum structure of the invention is shown in FIG. 7 which is a partial cross-sectional view of a carrier ring made of flexible and resilient metal in place on a drum similar to FIGS. 2 and 5 except that the ring structure is different. In FIG. 7 the drum 2 shown is identical to the drum of FIGS. 1 and 2 and can also optionally have vertical recesses 30 (not shown in the embodiment of FIG. 7).

In FIG. 7 ring 38 is firmly in place on the drum; frusto-conical inner skirt portion 39 fits tightly in recess 10 and curves downwardly and outwardly and then upwardly into a vertical, essentially cylindrical outer skirt or sidewall portion 40, then inwardly in the form of an essentially frusto-conical portion 42 joined to frusto-conical circumferential portion 32 which (i) fits snugly against the drum sidewall 8 above said circumferential ledge 14 of drum 2 (ii) extends above the top 4 of the drum (iii) has radially outwardly extending peripheral generally downwardly facing circumferential ledge 34, enabling engagement by chime-handling devices and by a fork lift.

Also shown in FIG. 7 is an identical container 2B which is supported by the top 4 of drum 2, at least when drum 2B is empty. The top of metal ring carrier 38 provides stacking stability and when drum 2B is heavily loaded may also support part of the weight of drum 2B.

Figure 8:
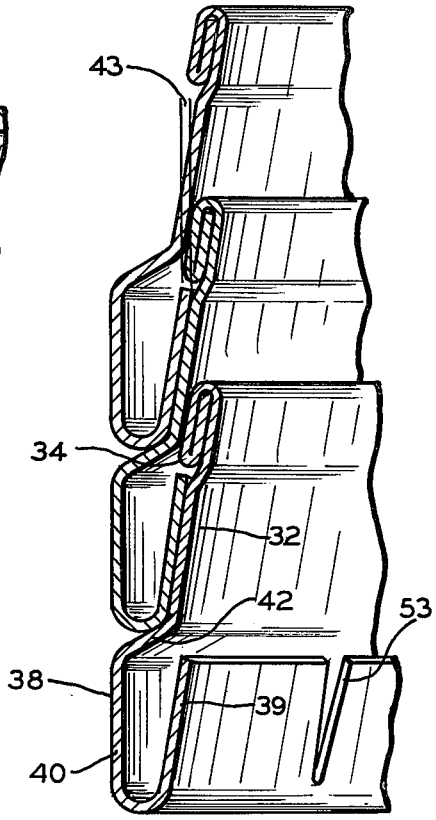
FIG. 8 shows in partial cross-section another circumferential ring carrier structure, several identical rings being nested together.

Shown in FIG. 8 in partial cross-section is another circumferential ring carrier structure that will form a stable nested stack of rings. Each nested metal ring carrier 38 in FIG. 8 is identical. Each ring has frusto-conical inner skirt portion 39 which has at least one slot 53 extending from its top at least part way to its base and which at its base curves downwardly and outwardly and then upwardly into a vertical skirt or sidewall portion 40, which from its top extends inwardly in the form of a frustum of a cone 42 having a smaller angle with the horizontal than said inner frustum 39, which frustum 42 extends into frusto-conical portion 32 which has (i) essentially the same angle with the horizontal as frusto-conical portion 39, (ii) essentially the same base outer diameter as the base inner diameter of frusto-conical portion 39, and (iii) terminates at its top with outwardly radially extending downwardly facing ledge 34 whose outer diameter is just slightly greater than the inner peripheral diameter of frusto-conical portion 39 so that each identical ring when nested over the other (i) snap fits past the ledge 34 of the next lower ring and is held in place by virtue of interference overlap shown at 43 and (ii) fits against and rests on frustum 32 of the next lower ring. These rings can be handled and installed on drums as described with respect to the rings of FIG. 6.

The use of the carrier rings of the present invention provides for handling not only by standard steel chime grippers, hand trucks and standard fork lifts, but also provides easy hand gripping for conventional hand rolling of the drums. Moreover, when used in connection with a drum having vertical recesses 30, the clearance afforded by the recesses allows lifting by hook and hoist. Another advantage is that slots 51, 53 allow drainage and prevent accumulation of liquids on the top 4 of the drum.

A further advantage of recesses 30 is that, if it is desired to remove the carrier ring, a saw can cut through the ring carrier where the ring traverses slot 30 without cutting the drum, thus allowing separation and removal of the ring.

As will be evident to those skilled in the art, various modifications of this invention can be made or followed in the light of the foregoing disclosure and discussion without departing from the spirit and scope of the disclosure or from the scope of the claims.

I claim:

1. A plastic drum adapted to receive a snap-on metal ring carrier structure, said drum having a top end, a bottom end, a circumferential sidewall joining said top and bottom ends, and near said top end a circumferential recess in said sidewall in the form of a frustum of a cone, said recess defining a first circumferential upwardly facing ledge at its bottom and a second circumferential downwardly and outwardly facing ledge at its top, the outer diameter of said second ledge being less than the outer diameter of said first ledge.

2. A plastic drum of claim 1 having a first vertical recess extending from below said circumferential recess to above said circumferential recess and being deeper than said circumferential recess, and one or more like vertical recesses circumferentially spaced from said first vertical recess.

3. In combination, a drum of claim 1 and a one-piece circumferential ring carrier structure made of flexible and resilient metal and having an inner frusto-conical skirt portion fitting tightly in said circumferential recess of said drum and curving at its bottom downwardly and outwardly, and then upwardly into a vertical essentially cylyndrical outer skirt portion, then inwardly in the form of an essentially frusto-conical portion extending into a circumferential portion fitting snugly against the drum sidewall above said second circumferential ledge of said drum, and finally extending upwardly and terminating slightly above the top end of said drum, said ring having near its top a generally downwardly facing ledge adapted to be engaged by chime handling equipment for lifting the drum, said inner skirt having at least one slot cut from its circumference, extending from the top of said inner skirt at least part way to the bottom of said inner skirt.

4. The combination of claim 3 wherein said ring structure fits snugly around the shoulder formed by the juncture of said top end and said sidewall of said drum.

5. The combination of claim 4 wherein at least one drain hole is provided in the bottom of said ring structure.

6. In combination, a drum of claim 2 and a one-piece circumferential ring carrier structure made of flexible and resilient metal and having an inner frusto-conical skirt portion fitting tightly in said circumferential recess of said drum and curving at its bottom downwardly and outwardly, and then upwardly into a vertical essentially cylyndrical outer skirt portion, then inwardly in the form of an essentially frusto-conical portion extending into a circumferential portion fitting snugly against the drum sidewall above said second circumferential ledge of said drum, and finally extending upwardly and terminating slightly above the top end of said drum, said ring having near its top a generally downwardly facing ledge adapted to be engaged by chime handling equipment for lifting the drum, said inner skirt having at least one slot cut from its circumference, extending from the top of said inner skirt at least part way to the bottom of said inner skirt.

7. The combination of claim 6 wherein said ring structure fits snugly around the shoulder formed by the juncture of said top end and said sidewall of said drum.

8. A plastic drum of claim 2 having attached thereto a circumferential carrier ring structure made of flexible and resilient metal and having an open circular top portion with a radially outwardly extending downwardly facing peripheral ledge engagable by standard steel drum chime handling devices and by fork lifts, and being locked in place on said drum by a lower frusto-conical inner slotted skirt portion of said ring structure which is snap fitted into, and locked in place in, said circumferential recess.

9. A plastic drum of claim 1 having attached thereto a circumferential carrier ring structure made of flexible and resilient metal and having an open circular top portion with a radially outwardly extending downwardly facing peripheral ledge engagable by standard steel drum chime handling devices and by fork lifts, and being locked in place on said drum by a lower frusto-conical inner slotted skirt portion of said ring structure which is snap fitted into, and locked in place in, said circumferential recess.

* * * * *